US008844762B2

(12) United States Patent
Chiou et al.

(10) Patent No.: US 8,844,762 B2
(45) Date of Patent: Sep. 30, 2014

(54) TRAVEL BEVERAGE CONTAINER

(71) Applicant: Ignite USA, LLC, Chicago, IL (US)

(72) Inventors: Joe Y. Chiou, Chicago, IL (US); David Joseph, Chicago, IL (US); Paul Hurley, Chicago, IL (US)

(73) Assignee: Ignite USA, LLC, Chicago, IL (US)

( * ) Notice: Subject to any disclaimer, the term of this patent is extended or adjusted under 35 U.S.C. 154(b) by 0 days.

(21) Appl. No.: 13/674,705

(22) Filed: Nov. 12, 2012

(65) Prior Publication Data

US 2013/0119060 A1 May 16, 2013

Related U.S. Application Data

(60) Provisional application No. 61/560,080, filed on Nov. 15, 2011.

(51) Int. Cl.

| | |
|---|---|
| ***A47G 19/22*** | (2006.01) |
| ***B65D 43/26*** | (2006.01) |
| ***B65D 51/18*** | (2006.01) |
| ***B65D 41/04*** | (2006.01) |
| ***B65D 47/08*** | (2006.01) |
| ***B65D 83/20*** | (2006.01) |
| ***B65D 43/02*** | (2006.01) |

(52) U.S. Cl.

CPC ..... *B65D 43/02* (2013.01); *A47G 19/2272* (2013.01)

USPC ..... 220/715; 220/254.3; 220/254.1; 220/826; 220/254.9; 215/305; 215/322; 222/407; 222/148; 222/153.04

(58) Field of Classification Search

USPC ..... 220/254.3, 254.1, 715, 826, 254.9; 215/305, 322; 222/470, 148, 153.04

See application file for complete search history.

(56) References Cited

U.S. PATENT DOCUMENTS

| | | | |
|---|---|---|---|
| 830,142 | A | 9/1906 | Ebbing |
| 1,072,588 | A | 9/1913 | Duncan |
| 2,193,232 | A | 3/1940 | Hacmac |
| 2,447,870 | A | 8/1948 | Polcyn |
| 2,622,420 | A | 12/1952 | Rice |

(Continued)

FOREIGN PATENT DOCUMENTS

| | | |
|---|---|---|
| JP | 2005193944 | 7/2005 |
| WO | 2005/115204 | 12/2005 |

OTHER PUBLICATIONS

International Preliminary Report on Patentability for related International Application No. PCT/US2012/064801, mailed May 20, 2014.

*Primary Examiner* — Fenn Mathew
*Assistant Examiner* — Jennifer Castriotta
(74) *Attorney, Agent, or Firm* — McDermott Will & Emery LLP

(57) ABSTRACT

A lid assembly for a beverage container having a lid housing, a seal assembly and a trigger member. The seal assembly has a drink seal to close the drink aperture. The seal assembly is rotatedly connected to the lid housing and movable between a use position and a cleaning position to allow the drink aperture to be open for cleaning. The trigger member is connected to the lid housing and is capable of engaging the seal assembly in the use position, but it cannot engage the seal assembly in the cleaning position. Additionally, a trigger lock is connected to the lid housing to prevent engagement of the seal assembly by the trigger member when the trigger lock is locked. The trigger lock may also contain a visual indicator to indicate that the lock is in the locked position.

17 Claims, 8 Drawing Sheets

(56) References Cited

U.S. PATENT DOCUMENTS

| | | | |
|---|---|---|---|
| 2,799,437 | A | 7/1957 | Jepson |
| 3,059,816 | A | 10/1962 | Goldstein |
| 3,635,380 | A | 1/1972 | Fitzgerald |
| 3,739,938 | A | 6/1973 | Paz |
| 3,964,631 | A | 6/1976 | Albert |
| 3,967,748 | A | 7/1976 | Albert |
| 3,972,443 | A | 8/1976 | Albert |
| 4,094,433 | A | 6/1978 | Numbers |
| 4,099,642 | A | 7/1978 | Nergard |
| 4,133,446 | A | 1/1979 | Albert |
| 4,136,799 | A | 1/1979 | Albert |
| 4,171,060 | A | 10/1979 | Howard et al. |
| 4,212,408 | A | 7/1980 | Valenzona |
| 4,276,992 | A | 7/1981 | Susich |
| 4,303,173 | A | 12/1981 | Negard |
| D288,667 | S | 3/1987 | Miner |
| 4,686,725 | A | 8/1987 | Mitchell |
| 4,706,313 | A | 11/1987 | Murphy |
| 4,711,372 | A | 12/1987 | Gach |
| 4,712,704 | A | 12/1987 | Ramsey et al. |
| 4,779,766 | A | 10/1988 | Kinsley |
| 4,801,053 | A | 1/1989 | Kaster |
| 4,881,668 | A | 11/1989 | Kitterman et al. |
| 4,901,387 | A | 2/1990 | Luke |
| D315,872 | S | 4/1991 | Bixler |
| 5,025,519 | A | 6/1991 | Spann et al. |
| 5,039,158 | A | 8/1991 | Maier |
| 5,070,560 | A | 12/1991 | Wilkinson |
| 5,082,134 | A | 1/1992 | Ramsey |
| 5,118,014 | A | 6/1992 | Hestehave et al. |
| 5,153,977 | A | 10/1992 | Toida et al. |
| 5,163,196 | A | 11/1992 | Graebe et al. |
| 5,169,016 | A | 12/1992 | Hinz, Jr. |
| 5,179,742 | A | 1/1993 | Oberle |
| 5,186,353 | A | 2/1993 | Ramsey |
| 5,199,597 | A | 4/1993 | Gladish |
| 5,222,623 | A | 6/1993 | Eger et al. |
| 5,244,113 | A | 9/1993 | Stymiest |
| 5,249,703 | A | 10/1993 | Karp |
| 5,252,278 | A | 10/1993 | Spann et al. |
| 5,307,950 | A | 5/1994 | Li |
| D355,322 | S | 2/1995 | Ackley et al. |
| 5,412,821 | A | 5/1995 | Wilkinson |
| 5,427,271 | A | 6/1995 | Wang |
| 5,461,741 | A | 10/1995 | Graebe |
| 5,462,185 | A | 10/1995 | Walker, III |
| 5,465,866 | A | 11/1995 | Belcastro |
| 5,477,980 | A | 12/1995 | Chaffin |
| 5,485,938 | A | 1/1996 | Boersma |
| D367,611 | S | 3/1996 | Wagner et al. |
| D373,927 | S | 9/1996 | Kramer et al. |
| 5,570,797 | A | 11/1996 | Yeh |
| 5,573,139 | A | 11/1996 | Yeh |
| 5,580,504 | A | 12/1996 | Spann et al. |
| 5,586,346 | A | 12/1996 | Stacy et al. |
| 5,596,781 | A | 1/1997 | Graebe |
| 5,606,754 | A | 3/1997 | Hand et al. |
| 5,630,238 | A | 5/1997 | Weismiller et al. |
| 5,649,331 | A | 7/1997 | Wilkinson et al. |
| 5,652,985 | A | 8/1997 | Wilkinson et al. |
| 5,666,681 | A | 9/1997 | Meyer et al. |
| 5,680,951 | A | 10/1997 | Feltman, III et al. |
| 5,689,845 | A | 11/1997 | Sobieralski |
| D386,948 | S | 12/1997 | Wissinger |
| 5,753,289 | A | 5/1998 | Ness |
| D394,778 | S | 6/1998 | Arns et al. |
| D397,905 | S | 9/1998 | Hsu |
| 5,845,352 | A | 12/1998 | Matsler et al. |
| D404,613 | S | 1/1999 | Hatsumoto et al. |
| D406,006 | S | 2/1999 | Hatsumoto et al. |
| D408,221 | S | 4/1999 | Asberg |
| D416,755 | S | 11/1999 | Trombly |
| 5,987,668 | A | 11/1999 | Ackley |
| D417,360 | S | 12/1999 | Bickert et al. |
| 6,010,029 | A | 1/2000 | Wang |
| 6,036,271 | A | 3/2000 | Wilkinson et al. |
| 6,053,474 | A | 4/2000 | Stucke et al. |
| 6,098,834 | A | 8/2000 | Hatsumoto et al. |
| 6,102,244 | A | 8/2000 | Kuwano et al. |
| 6,119,291 | A | 9/2000 | Osborne et al. |
| 6,126,035 | A | 10/2000 | Schaper et al. |
| 6,158,608 | A | 12/2000 | Schlattl |
| RE37,016 | E | 1/2001 | Morano |
| D437,229 | S | 2/2001 | Andrew |
| 6,223,369 | B1 | 5/2001 | Maier et al. |
| 6,276,560 | B1 | 8/2001 | Belcastro |
| D447,693 | S | 9/2001 | Warner et al. |
| 6,324,709 | B1 | 12/2001 | Ikeda et al. |
| 6,351,863 | B1 | 3/2002 | Meyer et al. |
| 6,352,166 | B1 | 3/2002 | Copeland |
| 6,401,990 | B1 | 6/2002 | Walters et al. |
| D460,894 | S | 7/2002 | Ziegenfus et al. |
| 6,443,325 | B1 | 9/2002 | Schaper et al. |
| 6,471,085 | B1 | 10/2002 | Gallo |
| D470,009 | S | 2/2003 | Poindexter et al. |
| D471,808 | S | 3/2003 | de Castro Couto |
| 6,557,717 | B1 | 5/2003 | Keck |
| 6,623,080 | B2 | 9/2003 | Clapper |
| 6,644,490 | B2 | 11/2003 | Clarke |
| 6,679,397 | B2 | 1/2004 | Smith et al. |
| 6,701,556 | B2 | 3/2004 | Romano et al. |
| 6,702,137 | B1 | 3/2004 | Kowa et al. |
| 6,732,875 | B2 | 5/2004 | Smith et al. |
| 6,732,876 | B2 | 5/2004 | Belcastro |
| 6,732,964 | B2 | 5/2004 | Couchey |
| 6,763,964 | B1 | 7/2004 | Hurlbut et al. |
| 6,782,574 | B2 | 8/2004 | Totton et al. |
| 6,854,615 | B2 | 2/2005 | von Ronn et al. |
| D502,844 | S | 3/2005 | Roho |
| 6,874,185 | B1 | 4/2005 | Phillips et al. |
| 6,901,617 | B2 | 6/2005 | Sprouse, II et al. |
| D508,185 | S | 8/2005 | Gauss |
| 6,922,863 | B2 | 8/2005 | Giori et al. |
| 6,928,681 | B1 | 8/2005 | Stacy |
| 6,952,852 | B2 | 10/2005 | Reeder et al. |
| 6,976,281 | B2 | 12/2005 | Schunk et al. |
| 6,978,910 | B2 | 12/2005 | Sanders et al. |
| D513,452 | S | 1/2006 | Parve |
| 7,011,227 | B2 | 3/2006 | Ward et al. |
| D522,794 | S | 6/2006 | Imar |
| D523,340 | S | 6/2006 | Westphal |
| 7,073,678 | B1 | 7/2006 | Dibdin et al. |
| D526,898 | S | 8/2006 | Isono et al. |
| D526,899 | S | 8/2006 | Mangin et al. |
| 7,086,107 | B2 | 8/2006 | Ellis et al. |
| D529,761 | S | 10/2006 | Trombly |
| D533,064 | S | 12/2006 | Glynn et al. |
| 7,195,137 | B2 | 3/2007 | Belcastro |
| D540,625 | S | 4/2007 | Sandberg |
| 7,201,288 | B2 | 4/2007 | von Ronn et al. |
| D541,572 | S | 5/2007 | Watanabe |
| D544,300 | S | 6/2007 | Tien |
| 7,229,134 | B2 | 6/2007 | Ito |
| D547,122 | S | 7/2007 | Gluck |
| D547,611 | S | 7/2007 | Seum et al. |
| D548,008 | S | 8/2007 | Lin |
| D548,508 | S | 8/2007 | Tonelli |
| D552,990 | S | 10/2007 | Vogel |
| D554,433 | S | 11/2007 | Gluck |
| D554,992 | S | 11/2007 | Mangin et al. |
| D555,000 | S | 11/2007 | Bunce et al. |
| D555,514 | S | 11/2007 | Munn |
| D555,970 | S | 11/2007 | Schreitmueller et al. |
| D558,111 | S | 12/2007 | Banks, III |
| D560,435 | S | 1/2008 | Meehan et al. |
| D564,840 | S | 3/2008 | Williams |
| D564,841 | S | 3/2008 | Clemens et al. |
| D564,874 | S | 3/2008 | Mangin et al. |
| D569,182 | S | 5/2008 | Homma |
| D572,531 | S | 7/2008 | Romandy et al. |
| D573,404 | S | 7/2008 | Wahl |
| 7,413,096 | B2 | 8/2008 | Morgan et al. |
| D577,582 | S | 9/2008 | Walsh et al. |
| D577,958 | S | 10/2008 | Homma |

(56) References Cited

U.S. PATENT DOCUMENTS

| | | | |
|---|---|---|---|
| D581,727 | S | 12/2008 | Pinelli et al. |
| D584,107 | S | 1/2009 | George |
| D587,060 | S | 2/2009 | Tong Chi Chung |
| D587,969 | S | 3/2009 | Gilbert |
| D588,411 | S | 3/2009 | Watanabe |
| D589,750 | S | 4/2009 | Liu et al. |
| D592,012 | S | 5/2009 | Carreno |
| D592,456 | S | 5/2009 | Pinelli |
| D592,905 | S | 5/2009 | Pinelli |
| D592,913 | S | 5/2009 | Pinelli |
| 7,546,933 | B2 | 6/2009 | Pinelli |
| D611,764 | S | 3/2010 | Wahl et al. |
| D623,473 | S | 9/2010 | Chen |
| D623,474 | S | 9/2010 | Carlson et al. |
| D623,476 | S | 9/2010 | Carlson et al. |
| D629,653 | S | 12/2010 | Gullickson et al. |
| D634,161 | S | 3/2011 | Roth et al. |
| RE42,484 | E | 6/2011 | Kitamura et al. |
| D640,094 | S | 6/2011 | Carlson et al. |
| 7,997,442 | B2 | 8/2011 | Pinelli |
| D648,985 | S | 11/2011 | Chiu et al. |
| D656,787 | S | 4/2012 | Phillips et al. |
| D658,443 | S | 5/2012 | Chiu et al. |
| 2003/0071041 | A1 | 4/2003 | Vogel |
| 2005/0028289 | A1 | 2/2005 | Hakamiun |
| 2006/0043091 | A1 | 3/2006 | Pinelli et al. |
| 2006/0226160 | A1 | 10/2006 | Elsaden et al. |
| 2007/0170184 | A1 | 7/2007 | Canedo |

TRAVEL BEVERAGE CONTAINER

CROSS-REFERENCE TO RELATED APPLICATIONS

This application claims the benefit of U.S. Provisional Patent Application No. 61/560,080, filed Nov. 15, 2011, which is incorporated herein by reference in its entirety and made a part hereof.

FEDERALLY SPONSORED RESEARCH OR DEVELOPMENT

Not Applicable.

TECHNICAL FIELD

The present invention relates generally to a beverage container, and more specifically to a travel beverage container with a cleanable and lockable trigger mechanism.

BACKGROUND OF THE INVENTION

Beverage containers and trigger mechanisms for beverage containers are well known in the art. Traditionally, trigger mechanisms are located in the lid of the beverage container and are secured in a fixed location in the lid. While such beverage containers and trigger mechanisms according to the prior art provide a number of advantages, they nevertheless have certain limitations. For example, debris may be retained between certain components that are secured together. Further, the area between the seals associated with the trigger mechanism and the lid, and other components of the trigger mechanism are difficult to properly clean, especially in a dishwasher environment. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY

According to one embodiment, the disclosed subject technology relates to a lid for a beverage container having a drop-down seal assembly for easy cleaning of the seal assembly and the associated drink apertures, but where the seal assembly is not disassembled or removed from the lid during conversion from the use position to the cleaning position, and wherein the seal assembly is operated by a trigger assembly that is pushed radially inwardly in a direction transverse to a longitudinal axis of the beverage container.

The disclosed subject technology further relates to a lid having a lock connected to the lid housing. The lock prevents engagement of the seal assembly by the trigger assembly even when the seal assembly is in the operable position.

The disclosed subject technology further relates to a lid having a seal assembly and a trigger member. The seal assembly has a drink seal that engages a first drink aperture to close the drink aperture. The seal assembly is rotatedly connected to the lid housing and movable between a first or operable position, and a second or cleaning position. The seal assembly can be rotated away from a drink surface of the lid housing so that the drink aperture is open for cleaning the lid assembly in the cleaning position. The trigger member is connected to the lid housing and is capable of engaging the seal assembly in the operable position, but the trigger assembly cannot engage the seal assembly in the cleaning position.

The disclosed subject technology further relates to a seal assembly further comprising a hinge member and a seal arm. The hinge member is pivotally connected to the lid housing, and the seal arm is pivotally attached to the hinge member.

The disclosed subject technology further relates to an embodiment having a locking member to lock the seal assembly in the operable position when the locking member is in a locked state. The locking member is transitionable to an unlocked state to allow the seal assembly to translate to the cleaning position.

The disclosed subject technology further relates to a lid assembly for a beverage container comprising a lid housing, a seal assembly, a trigger assembly and a trigger lock. The seal assembly is connected to the lid housing and has a drink seal to close a drink opening in the lid housing. The trigger assembly is connected to the lid housing to operate the seal assembly. The trigger lock is connected to the lid housing to prevent engagement of the seal assembly by the trigger assembly in a first position.

The disclosed subject technology further relates to a lock that contains a visual indicator to indicate that the lock is in a locked position.

The disclosed subject technology further relates to a lock is pivotally connected to the lid assembly.

The disclosed subject technology further relates to a lock that extends from a top of the lid assembly.

The disclosed subject technology further relates to a lock that is movable from a first position, wherein the lock engages the trigger assembly and prevents the trigger assembly from engaging the seal assembly, to a second position, wherein the lock does not engage the trigger assembly and the trigger assembly is free to engage the seal assembly.

The disclosed subject technology further relates to a lid assembly for a beverage container comprising a lid housing, a seal assembly connected to the lid housing and having a drink seal to close a drink opening in the lid housing, and a lock connected to a top of the lid housing. The lock is moveable to a locked position to prevent engagement of the seal assembly so that the drink seal remains engaged to close the drink opening.

The disclosed subject technology further relates to a lid assembly for a beverage container comprising a lid housing having a drink opening and a separate vent aperture, a seal assembly and a trigger mechanism. The seal assembly is pivotally connected to the lid housing and movable between a first or operable position, wherein a drink seal of the seal assembly engages a drink opening to close the drink opening, and a second or cleaning position, wherein the seal assembly is rotated away from a drink surface of the lid housing and wherein the drink opening is open for cleaning the lid assembly. The trigger mechanism is mechanically connected to the seal assembly during operation of the trigger mechanism to move the drink seal and a vent seal from a closed position to an open position, wherein the vent seal is opened during a first portion of the operation of the trigger mechanism and wherein the drink seal is opened during a second portion of the operation of the trigger mechanism so that the vent seal is opened before the drink seal.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present invention, it will now be described by way of example only, not by way of limitation, with reference to the accompanying drawings in which.

DETAILED DESCRIPTION

Figure 1:
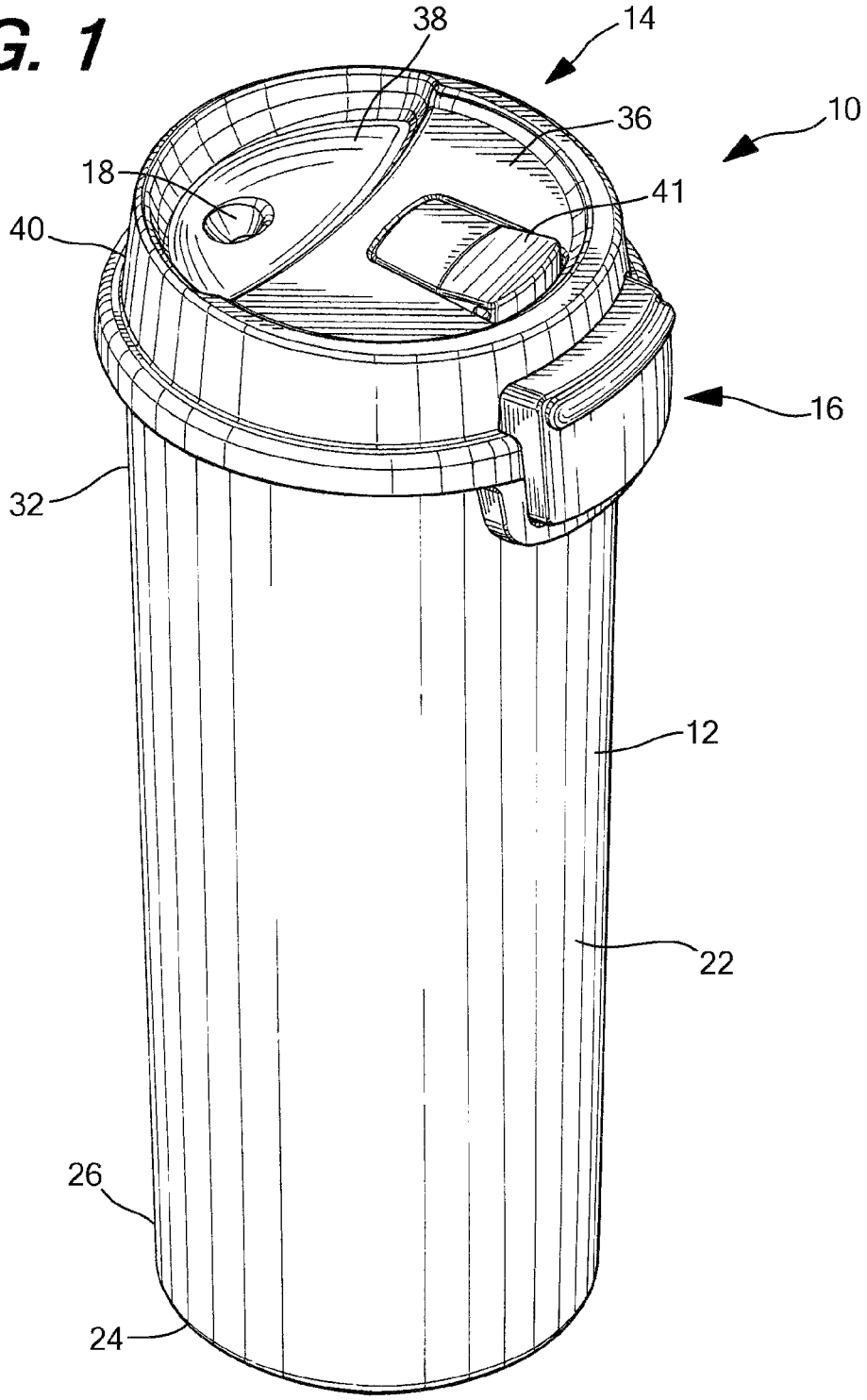
FIG. 1 is a perspective view of one example of a beverage container with a moveable and lockable trigger mechanism.
Figure 2:
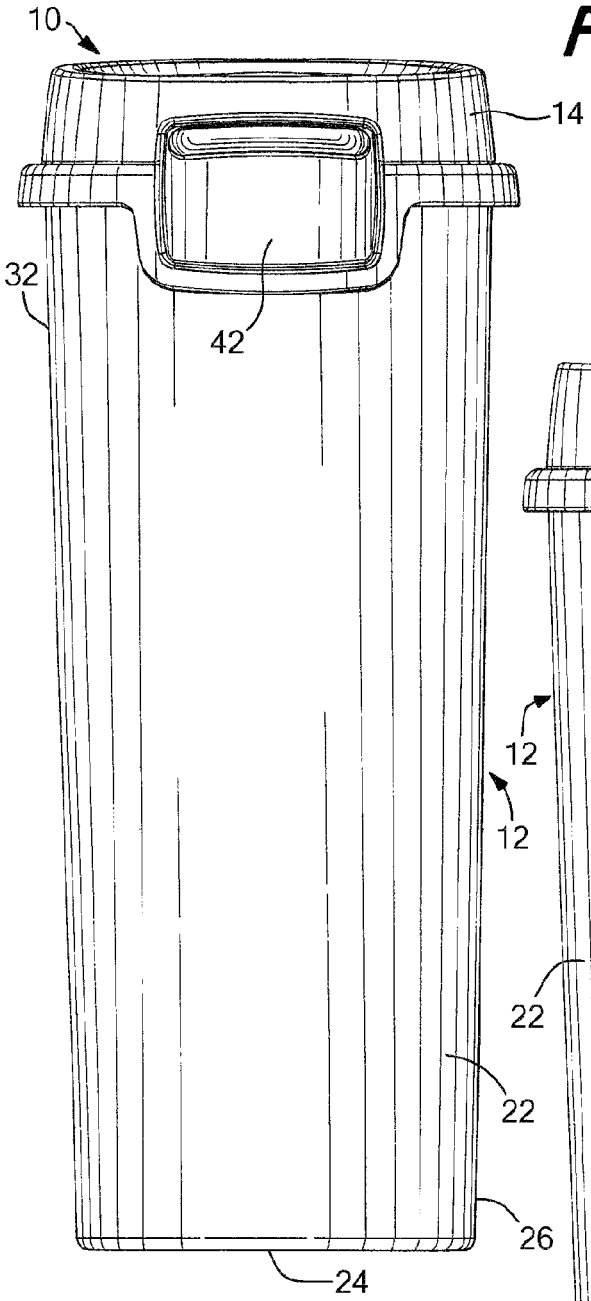
FIG. 2 is a front elevation view of the beverage container of FIG. 1.
Figure 3:
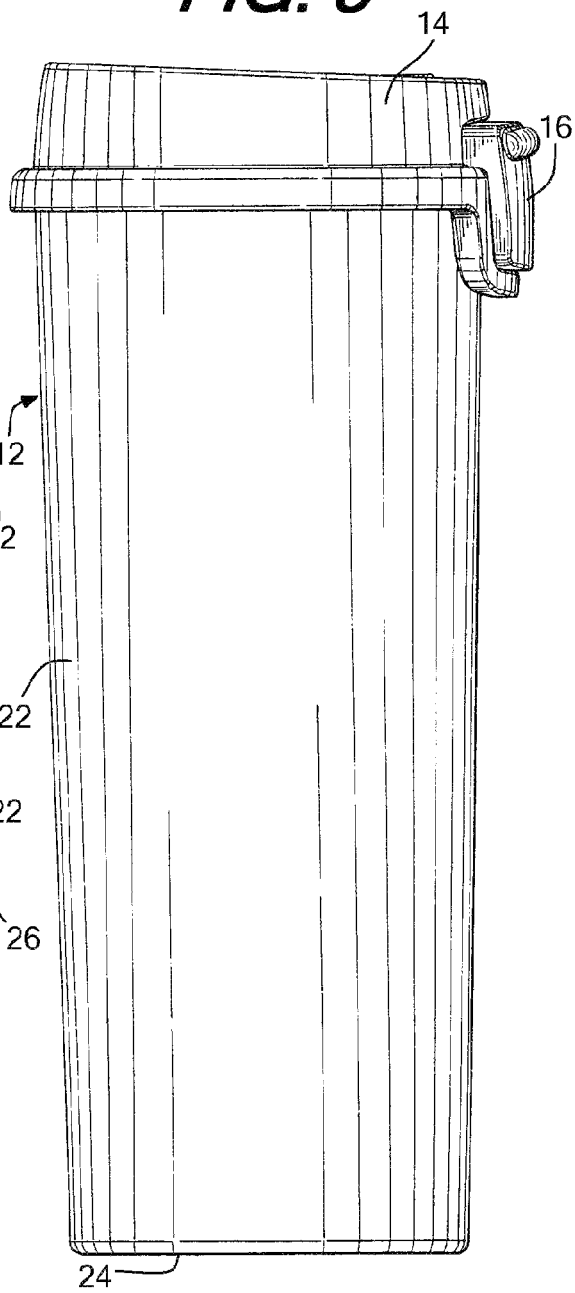
FIG. 3 is a side elevation view of the beverage container of FIG. 1.
Figure 4:
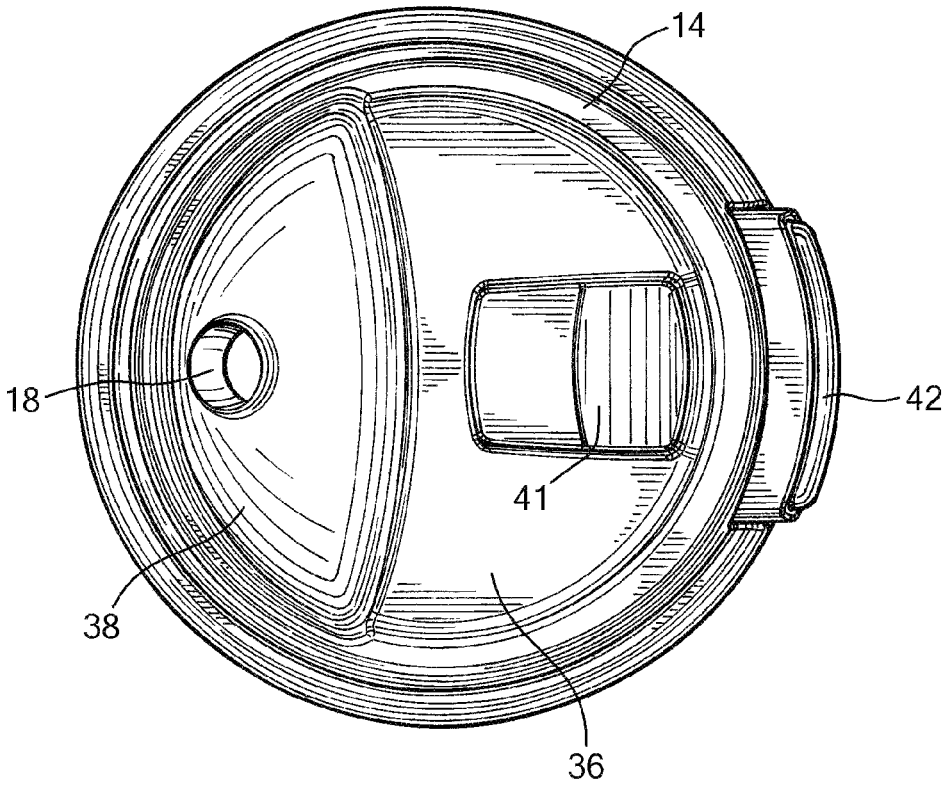
FIG. 4 is a top plan view of the beverage container of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 5:
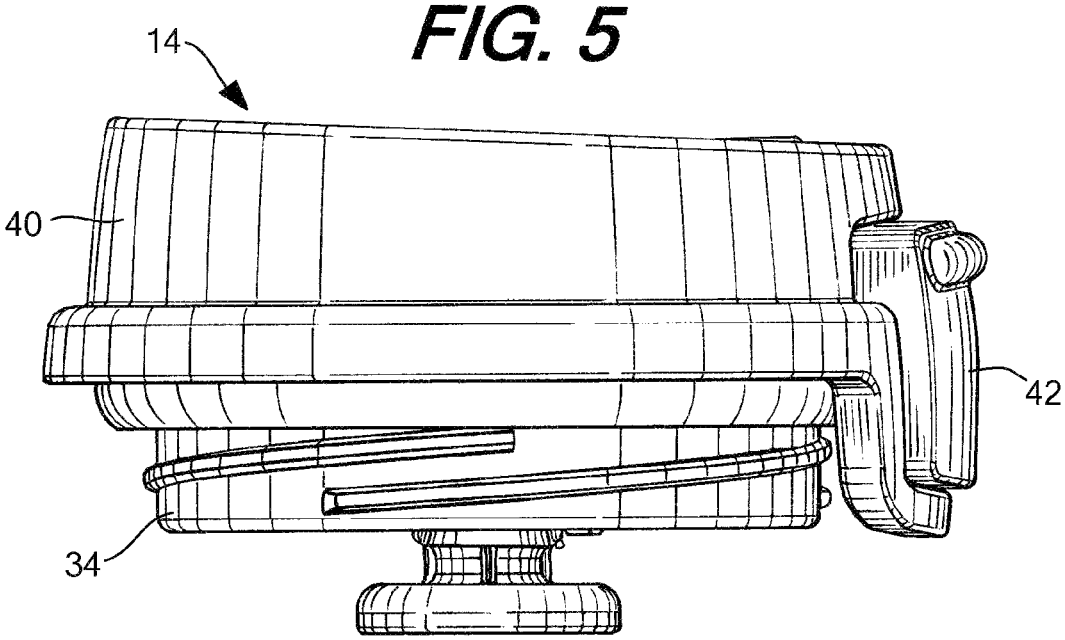
FIG. 5 is a side elevation view of one embodiment of a lid for a beverage container, including a thread ring for the lid.
Figure 6:
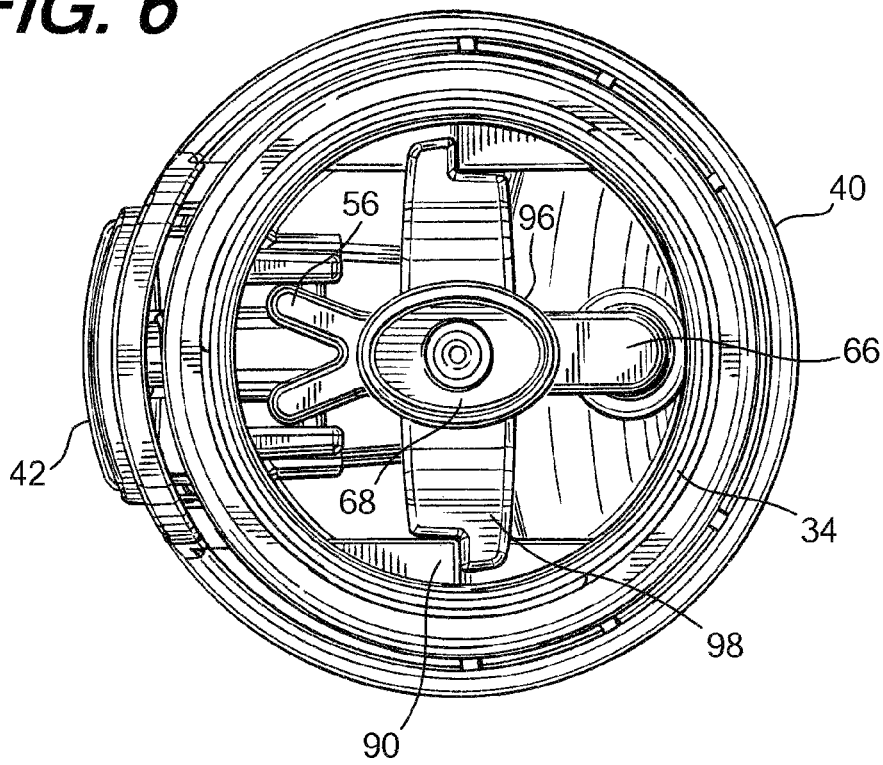
FIG. 6 is a bottom plan view of one embodiment of a trigger mechanism for a beverage container, with the seal assembly in the engaged position.
Figure 7:
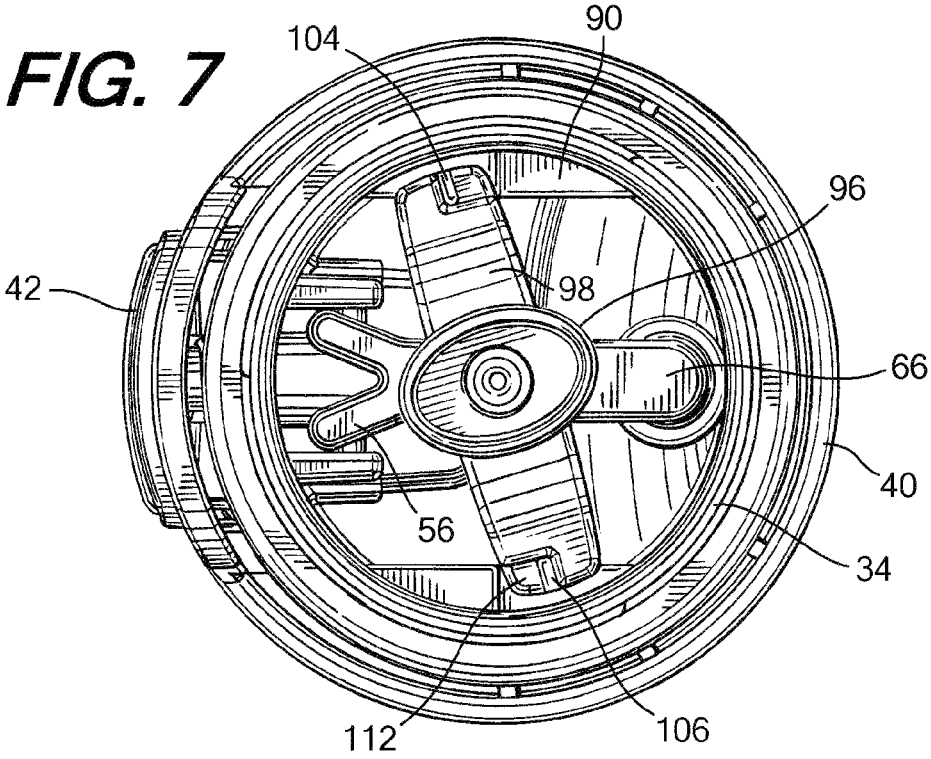
FIG. 7 is a bottom plan view of the trigger assembly of FIG. 6, with the seal assembly in the disengaged position.
Figure 10:
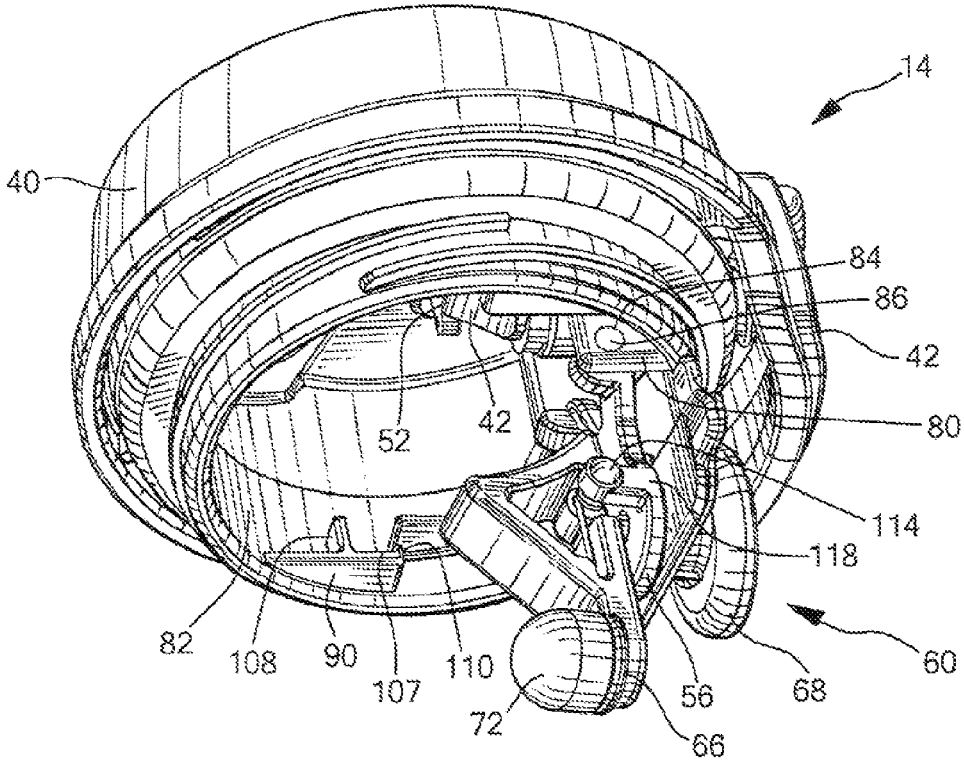
FIG. 10 is a partial bottom perspective view of one embodiment of the seal mechanism in the open position.

Referring now to the figures, and specifically to FIGS. 1-8, there is shown a beverage container 10 generally comprising a container body 12 and a lid assembly 14. The lid assembly 14 has a trigger mechanism 16 that operates to open and close a drinking aperture 18 in the lid assembly 14. Additionally, the trigger mechanism 16 also preferably operates to open and close a vent aperture 20 to allow pressure residing within the container body 12 to be released initially through the vent aperture 20 as opposed to the drink aperture 18. In a preferred embodiment, as shown in FIGS. 7 and 10, a portion of the trigger mechanism 16, referred to herein as the seal mechanism, can be released from a fixed or closed position to a released or open position to allow for cleaning of various components of the trigger mechanism 16 and for cleaning of areas between components of the trigger mechanism 16 and the lid assembly 14.

In one embodiment the container body 12 comprises a side wall member 22, a bottom member 24 toward a distal end 26 of the side wall member 22, and a liquid retaining cavity (not shown) therebetween. Further, in another embodiment the container body 12 preferably comprises a two-part construction of an inner member and an outer member to provide an insulating feature. The area between the inner member and the outer member may be filled with an insulating material or it may be under vacuum.

Figure 8:
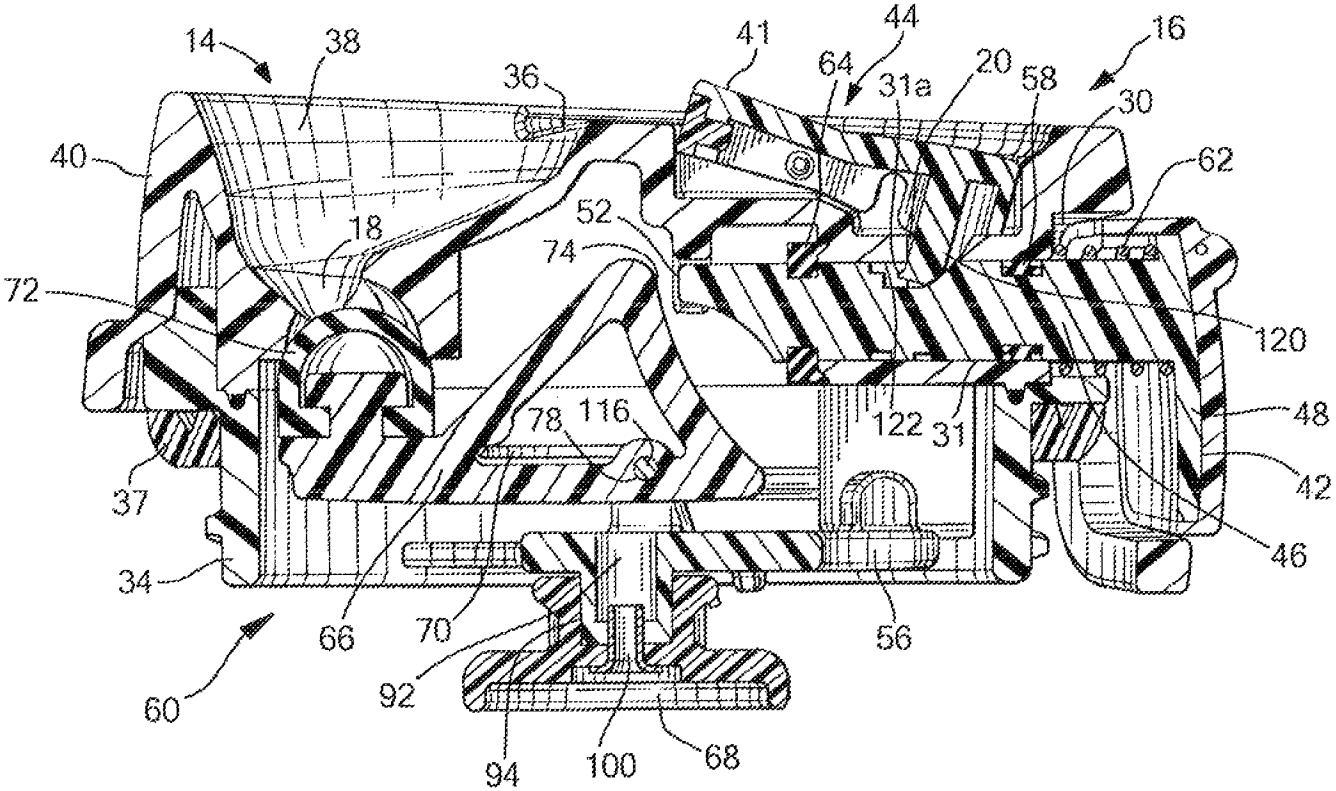
FIG. 8 is a partial cross-section side view of one embodiment of the trigger mechanism with the trigger in the normal position and the vent-trigger lock in the locked position.
Figure 9:
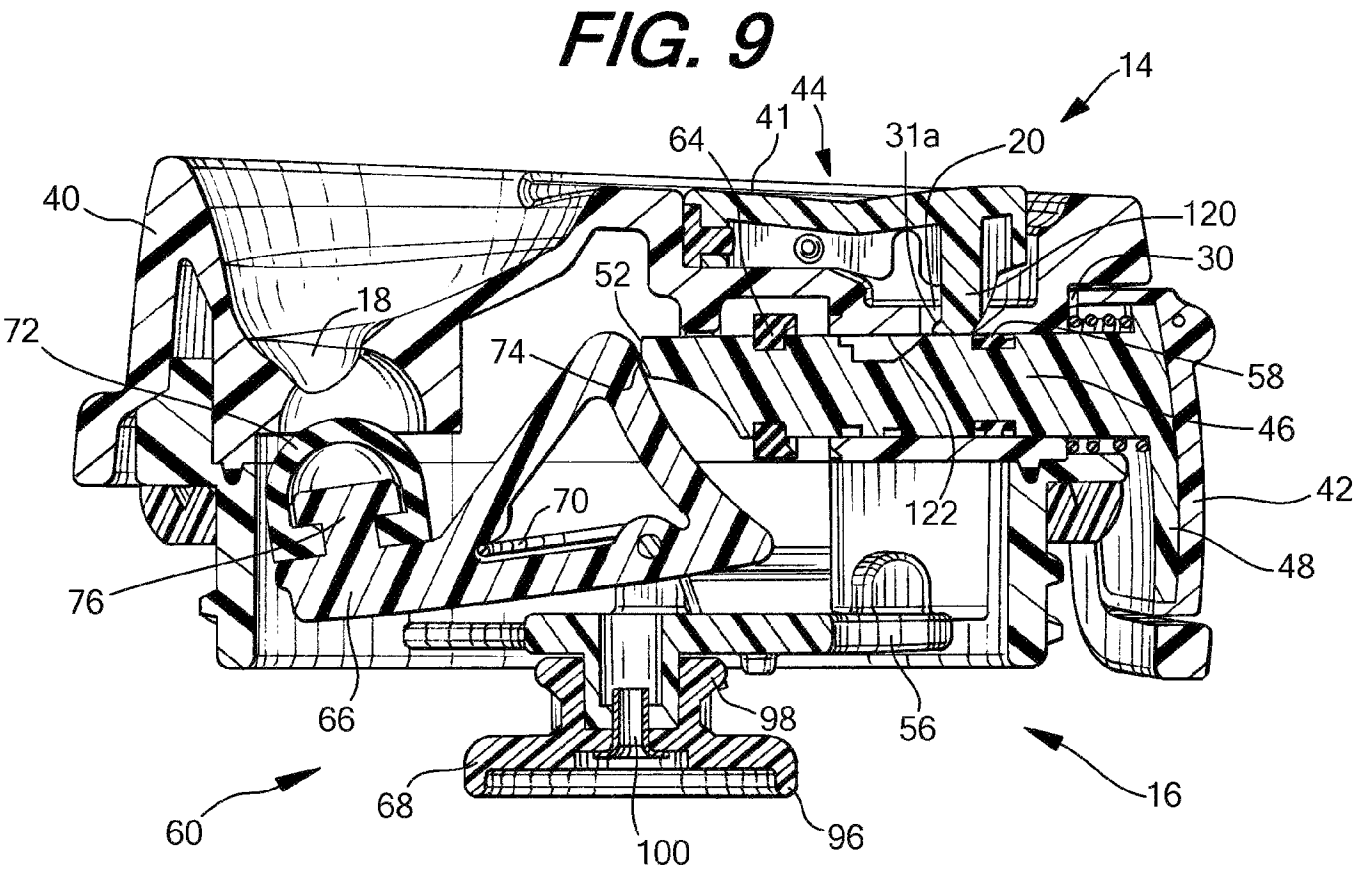
FIG. 9 is a partial cross-section side view of one embodiment of the trigger mechanism with the trigger in the actuated position and the vent-trigger lock in the open position.

The lid assembly 14 provides a closure to the cavity of the container body 12. In one embodiment, the container body 12 base has a receiver (not shown) at a proximal end 32 of the container body 12 for assisting in securing the lid assembly 14 to the container body 12, and in a preferred embodiment the lid assembly 14 is secured to the container body 12 via the thread ring 34 on the lid assembly 14 and a mating receiver on the container body 12, however, alternate connection means may be utilized. In one embodiment the thread ring 34 extends from or is fixedly connected to the lid housing 40, such as via welding of the two components, as shown in FIGS. 5, 8 and 9. As shown in FIGS. 8 and 9, the lid assembly 14 further includes a seal 37 that seals the connection between the container body 12 and the lid assembly 14 to assist in preventing liquid from escaping from the cavity of the container body 12 between the container body 12 and the lid assembly 14.

In one embodiment the lid assembly 14 comprises a lid housing 40 for retaining the trigger mechanism 16. In one embodiment the top surface 36 of the lid housing 40 has a depression 38 leading to the drink aperture 18. The depression in the top surface 36 allows fluid to be dispensed from the container through the drink aperture 18, and to be subsequently slurped by the user. Further, because the depression provides for pooling of liquid, the surface of the depression 38 may have a highly polished finish to allow any liquid that is not drunk by the user to quickly retreat back through the drink aperture 18 and into the container cavity upon tilting of the drinking container 10 toward the vertical position.

As shown in FIGS. 1-7, the lid assembly 14 also has a trigger member or trigger button 42 that operates to actuate the trigger mechanism 16, and as shown in FIGS. 8-9 and 12-15, the lid assembly 14 also has a trigger lock mechanism 44 for locking the trigger member 42 and preventing the user from actuating the trigger mechanism 16 when the trigger member 42 is locked to prevent unwanted opening of the drink aperture 18.

The lid housing 40 of the lid assembly 14 has a plurality of apertures therein. Preferably, the lid housing 40 contains the drink aperture 18 (see FIGS. 1 and 9) and the vent aperture 20 (see FIGS. 9 and 12) that provide egress for the contents in the container cavity through the lid housing 40. Generally, the operation of the trigger assembly 16, and particularly the operation of the vent seal 64 of the vent aperture 20, provides to allow pressure residing within the container body 12 to preferably be initially released through the vent aperture 20 as opposed to the drink aperture 18. In one embodiment, the vent aperture 20 is provided in a position in the lid housing 40 that is underneath the vent deflector 41 that is a part of the trigger lock mechanism 44.

As best shown in FIGS. 6-11, in various embodiments the trigger assembly 16 generally comprises a trigger member 42, a hinge member 56, a trigger seal 58, a trigger spring 62, a vent seal 64, a seal arm 66, a seal arm locking member 68, a drink spring 70 and a drink seal 72. Further, a portion of the overall trigger assembly 16 may be referred to as the seal assembly 60. In one embodiment the components of the seal assembly 60 generally comprise the hinge member 56, the seal arm 66, the seal arm locking member 68, the drink spring 70 and the drink seal 72.

Referring to FIGS. 8-10, in one embodiment the trigger member 42 of the trigger assembly 16 is generally L-shaped, with a main body portion 46 and a transverse portion 48 extending downwardly therefrom. Moreover, in a preferred embodiment the main body portion 46 has a shaft-like shape. The main body portion 46, however, has various cutouts about an exterior of its body to allow gaseous fluid to pass by the exterior of the trigger member and out the vent aperture 20. The trigger member 42 has a distal end 52 that engages the seal arm 66 to rotate the seal arm 66 about its pivot point, as discussed more fully herein, thereby disengaging the drink seal 72 from the drink aperture 18 in the lid assembly 14 to operably open and close the drink aperture 18.

The main body portion 46 of the trigger 42 extends through an access aperture 30 in the lid housing 40, and into a trigger chamber 31 in the lid assembly 14. A portion of the main body portion 46 of the trigger 42 is generally housed within the trigger chamber 31, and a portion of the main body portion 46 of the trigger 42, including the distal end of the trigger 52, extends out of the trigger chamber 31, which can also be referred to as the vent chamber, and into the cavity of the lid assembly 14 to contact the seal arm 66.

In a preferred embodiment the trigger 42 also seats several seals, including the trigger seal 58 and the vent seal 64. As shown in FIGS. 8 and 9, the trigger seal 58 and the vent seal 64 are both seated on the main body portion 46 of the trigger 42. Since the trigger 42 extends through the access aperture 30 and through the vent chamber, the trigger seal 58 is required to seal the access aperture opening 30 once the trigger 42 is inserted into the lid assembly 14. In a preferred embodiment the interior of the trigger chamber 31, a portion of which comprises the vent chamber, has a cylindrical shape and thus in this embodiment the trigger seal 58 is a wiper O-ring that is seated in an arcuate recess on the main body portion 46 of the trigger 42. The trigger seal 58 thus operates as a wiper seal contacting the interior surface of the trigger chamber 31 to seal the area between the interior surface of the trigger chamber 31 and the trigger 42 to prevent any liquid or vapor from escaping out of the trigger chamber 31 through the access aperture 30. The trigger seal 58 is positioned on the trigger 42 between the vent aperture 20 and the access aperture 30. In this manner the trigger seal 58 also operates as an end wall for the vent chamber portion 31*a* of the trigger chamber 31.

The vent seal 64 is also seated on the main body portion 46 of the trigger 42, however, the vent seal 64 is seated more toward the distal end 52 of the trigger 42 than the trigger seal 58. Like the trigger seal 58 the vent seal 64 is seated in an arcuate recess on the main body portion 46 of the trigger 42. This recess, however, is positioned outside of the trigger chamber 31 and adjacent the entrance aperture to the trigger chamber 31 and vent chamber 31*a*. Accordingly, in this manner the vent seal 64 operates to seal the entrance to the vent chamber 31*a* and trigger chamber 31 in a first normal position, as shown in FIG. 8, and to open the entrance to the vent chamber 31*a* and trigger chamber 31 immediately upon actuation of the trigger mechanism 16, including in the fully actuated position of FIG. 9.

Referring to FIGS. 8 and 9, the trigger spring 62 is positioned around the main body portion 46 of the trigger 42 between an exterior wall of the lid housing 40 and the transverse portion 48 of the trigger member 42. In a preferred embodiment the trigger spring 62 is a compression spring. Since the first end of the trigger spring 62 is fixed in place against the exterior wall of the lid housing 40 that does not move, the second end of the trigger spring 62 exerts an outwardly force on the trigger 42 in an attempt to maintain the trigger 42 in the normal or unactuated position (see FIG. 8). In this position the vent seal 64 is pushed up against the outside of the trigger chamber 31 at the entrance thereto, effectively sealing the entrance to the vent chamber 31*a* and the trigger chamber 31 to preclude any liquid or vapor from being able to escape out of the container cavity prior to actuation of the trigger assembly 16.

The transverse portion 48 of the trigger member 42 is fixedly connected to and preferably integral with the main body portion 46 of the trigger member 42. Thus, the transverse portion 48 operates as a push-button actuator to actuate the trigger mechanism 16 and sealing assembly 60. The trigger mechanism 16 can be actuated by exerting a generally radially inward force on the trigger member 42 to overcome the opposite force of the trigger spring 62 to push the trigger member 42 radially inward in the lid assembly 14 or toward a center of the lid assembly 14, and preferably in a direction transverse to an axis extending about a length of the beverage container 10. The trigger member 42 is thus moveable from a first normal or non-actuated position shown in FIG. 8, to a partially actuated position (not shown), and ultimately to a fully actuated position shown in FIG. 9. In the partially actuated position the vent seal 64 is in the open position allowing vapor and internal pressure to be released from the container cavity through the trigger chamber 31 and vent chamber and to exit out the vent orifice 20, but the drink seal 72 is closed sealing the drinking orifice 18. The gap between the distal end 52 of the trigger member 42 and the seal arm 66, shown in FIG. 8, provides a delay whereby the vent seal 64 will be moved from the opening to the trigger chamber 31 and vent chamber 31*a* allowing vapor and internal pressure to be released out the vent opening 20, but the distal end 52 of the trigger member 42 will not have contacted or engaged the seal arm 66 so the drink seal 72 remains closed on the drink opening 18. Conversely, in the fully actuated position (FIG. 9) the distal end 52 of the trigger member 42 has engaged the seal arm 66, thereby rotating the seal arm 66 about its pivot point 78, such that both the vent seal 64 and drink seal 72 are in the open position allowing liquid to be expelled out the drinking orifice 18 and allowing vapor and pressure to continue to be released from the vent opening 20.

As explained above and shown in the Figures, the trigger 42 is mechanically connected to the drink seal 72 through the seal arm 66 when the trigger 42 is actuated a sufficient distance such that the distal end 52 of the trigger 42 contacts the seal arm 66.

Figure 11:
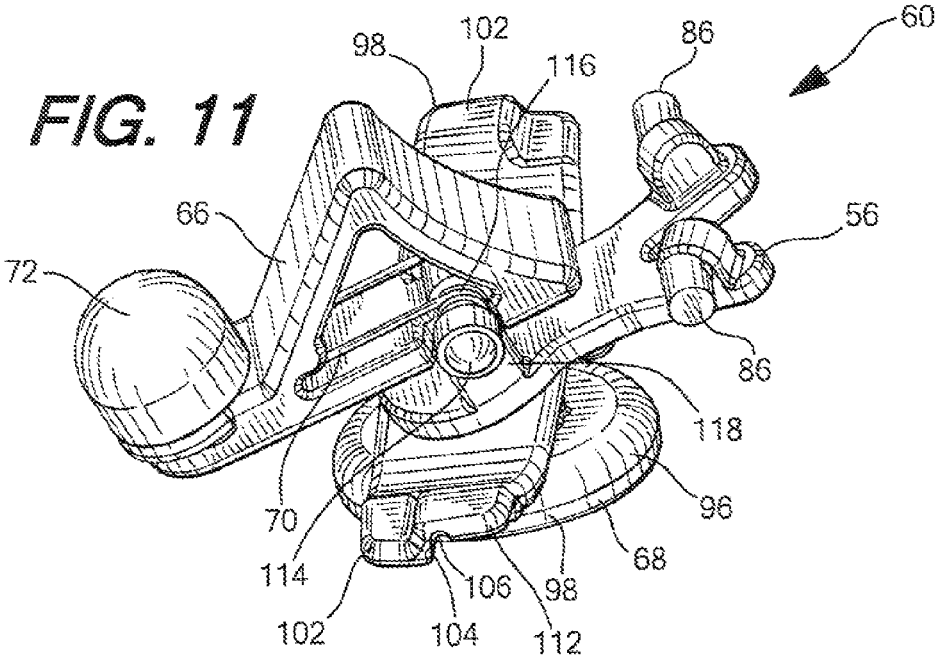
FIG. 11 is a partial top perspective view of one embodiment of the seal mechanism apart from the lid.

Referring to FIGS. 6-11, in one embodiment a portion of the trigger assembly 16, preferably the seal assembly 60, is hingedly connected to the lower or interior portion of the lid housing 40 of the lid assembly 14. In one embodiment, a pair of arms 80 extend transversely from the interior wall 82 of the lid housing 40 (see FIG. 10) to secure the seal assembly 60 to the lid housing 40. The arms 80 have a receiver 84 for rotatably securing the hinge member 56 to the lid housing 40. The receiver 84 in the arms 80 is a bore 84 that is sized to allow extensions 86 of the hinge member 56 to extend and rotate therewithin. Referring to FIGS. 10 and 11, in one embodiment the extensions 86 comprise shaft-like members that extend from the body of the hinge member 56 and into the receivers 84 in the arms 80 of the lid housing 40. As such, the hinge member 56, and the seal assembly 60 therewith, can rotate down from its engaged position in the unlocked position of the seal assembly 60 about the extensions 86 that rotate within the receivers 84 to allow access to various components of the seal assembly 60, trigger assembly 16 and lid assembly 14 for cleaning purposes.

The seal assembly 60, however, can be locked and unlocked to the lid housing 40 to either maintain the seal assembly 60 in the operable position (as shown in FIGS. 6, 8 and 9), or to allow the seal assembly 60 to be rotated downward (as shown in FIGS. 7 and 10). Referring to FIGS. 6-11, the pivotable portion of the seal assembly 60 comprises the hinge member 56, the seal arm locking member 68, the seal arm 66, the drink spring 70 and the drink seal 72. In one embodiment, the seal arm locking member 68 comprises a locking member portion or knob 96 and a pair of locking arms 98. In a preferred embodiment, the knob 96 and locking arms 98 that form the seal arm locking member 68 are a unitary component.

The seal arm locking member 68 is the component of the seal assembly 14, and thus the trigger assembly 16 as well, that is used to lock the seal assembly 14 and trigger assembly 16 in the operable position, and further unlock the seal assembly 14 and trigger assembly 16 for transitioning to the unlocked or cleaning position. In one embodiment, the seal arm locking member 68 is fixedly secured to the hinge member 56, such as with a rivet 100. In a preferred embodiment, the locking member 68 can rotate with respect to the hinge member 56 to allow the seal arm locking member 68 to transition from the locked position to the unlocked position. As shown in FIGS. 8 and 9, in one embodiment the knob 96 has a cylindrical receiver 94 and the hinge member 56 has a protruding cylindrical shoulder 92 that engages the receiver 94. In this orientation the seal arm locking member 68 can thus rotate about the protruding shoulder 92.

As best shown in FIGS. 6-7 and 10-11, the locking arms 98 of the seal arm locking member 68 extend transversely from the knob member 96. In one embodiment the seal arm locking member 68 has two locking arms 98 extending in opposite directions and spaced apart at approximately 180° to one another. In a preferred embodiment, each of the locking arms 98 have a distal end portion 102 that operates as a cam member to engage a cam surface of respective receiving members 90 on the inner wall 82 of the thread ring 34 of the lid housing 40. Referring to FIGS. 6, 7 and 11, the distal end portions 102 of the locking arms 98 have a raised portion 112, a stop 104 and a locking receiving member 106 that operate as cam followers on the cam member portions of the receiving members 90. In one embodiment the locking receiving member 106 is an indent that receives a mating protrusion in a snap-fit configuration.

In one embodiment the lid housing 40 has a pair of receiving members 90 that provide a cam receiving surface for receiving the locking arms 98 and locking the seal arm locking member 68, and thus the seal assembly 60, in the locked position. Referring to FIG. 10, in one embodiment, the receiving members 90 comprise a flat member 107 that extends transversely from the interior wall 82 of the lid housing 40. The receiving members 90 also have a stop portion 108 that extends transversely from the interior wall 82 of the lid housing 40, preferably at approximately 90° to the flat member. Finally, the receiving members 90 have a locking protrusion 110. Thus, in one embodiment the receiving members 90 are generally L-shaped and have a transverse portion (i.e., the stop 108) and horizontal portion (i.e., the flat member 107) thereto. The horizontal portions 107 of the pair of receiving members 90 extend toward one another from opposing sides of the interior wall 82 of the lid housing 40. As shown in FIGS. 6 and 7, the raised portion 112 of the locking arms 98 engage the flat member 106 of the receiving members 90 when the seal arm locking member 68 is pushed inwardly toward a top of the lid housing 40 and rotated to the closed position. The seal arm locking members 68 can be rotated from their position shown in FIG. 7, on flat member 107 (i.e., cam surface) of the receiving members 90, until the stops 104 of the locking arms 98 engage the respective stops 108 of the receiving members 90. At that point, the locking protrusions 110 of the receiving members 90 will engage the respective locking receiving members for indents) 106 of the seal arm locking members 68 in a snap-fit orientation to lock the seal assembly 60 to the lid assembly 14 in the closed or locked position in the lid assembly 14 (see FIG. 6). Accordingly, the flats of the receivers 90 respectively operate as cam surfaces for the cam follower raised portions 112 of the locking arms 98. And, the locking receiving members 106, which in one embodiment is a depression or indent, that engage the protrusions 110 provide a tactile sensation, in a snap-fit manner, to the user that the proper rotation stroke has been reached when locking and unlocking the seal arm locking member 68. The engagement of the locking protrusions 110 in the locking receiving members 106 also operates to fix the seal assembly 60 in the locked position until the user rotates the knob 96 to unlock the seal assembly 60 for cleaning. In this manner the seal assembly 60 will not become unintentionally unlocked.

To unlock the seal arm locking member 68, and thus the seal assembly 60, the user pushes the seal assembly 60 slightly upwardly toward the lid housing 40 and performs a reverse rotation of the locking member 68. When this reverse rotation of the seal arm locking member 68 is performed, the protrusions 110 of the receiving members 90 will disengage from the indents 106 of the locking arms 98 and the locking arms can be rotated to the position shown in FIG. 7.

Referring now to FIGS. 8-11, in one embodiment the seal arm 66 of the seal assembly 60 is pivotally attached to the hinge member 56. The seal arm 66 has an engaging surface 74 that is engaged by the distal end 52 of the trigger 42 during actuation of the trigger mechanism 16. As shown in FIG. 8, the engaging surface 74 of the seal arm 66 is positioned a gap distance from the distal end 52 of the trigger member 42 in the unactuated position. The seal arm 66 also has an extension 76 to retain the drink seal 72. The extension 76 of the seal arm 66 is positioned opposite the engaging surface 74.

As shown in FIGS. 10 and 11 a pin or shaft 114 secures the seal arm 66 to the hinge member 56 is a pivoting manner. The seal arm 66 has a bore 116 through which the shaft 114 extends, and the hinge member 56 has a pair of receivers 118 that receive and secure the shaft 114 in place. Accordingly, the seal arm 66 is pivotally attached to the hinge member 56.

The drink spring 70, shown in FIGS. 10 and 11, is also provided as part of the seal assembly 60 to exert a force on the seal arm 66 to maintain the drink seal 72 in the closed position until a sufficient force is provided against the seal arm 66 through the trigger mechanism 16 to overcome the force of the drink spring 70 and thus pivot the seal arm 66 and drink seal 72 about the shaft 114 away from the drink aperture 18. During rotation of the seal arm 66 the hinge member 56 remains fixed in place and does not move. In one embodiment, the drink spring 70 is a torsion spring that is exerts a pressure on the seal arm 66 such that the seal arm 66 is forced away from the hinge member 56. Thus, when the seal assembly 60 is positioned in the locked or operational position (see FIGS. 6 and 8) the locking arms 98 of the seal arm locking member 68 are secured to the lid housing 40 through the receiving members 90. In this position, the drink seal 72 of the seal assembly 60 is forced against the drink opening 18 via the drink spring 70 to close the drink opening 18 (see FIG. 8).

When the user desires to drink from the container 10, the user depresses the trigger member 42 by pushing the trigger member 42 inward toward the container body 12 with sufficient force to overcome the resistance force of the trigger spring 62. The trigger member 42 moves inwardly and the vent seal 64 is moved from the entrance to the trigger chamber 31 and vent chamber 31*a*. During the beginning portion of the stroke of the trigger member 42 the distal end 52 of the trigger member 42 remains out of contact of the seal arm 66 because of the gap between the seal arm 66 and the trigger member 42 (see FIG. 8). When sufficient stroke of the trigger member 42 has occurred, the distal end 52 of the trigger member 42 will contact the seal arm 66. Further stroke movement of the trigger member 42 will operate to push against the seal arm 66, thereby causing the seal arm 66 to rotate about the shaft 114 at its pivot point 78 within the receivers 118 of the hinge member 56 because the hinge member 56 is fixed in the locked position. To rotate the seal arm 66 the force exerted on the trigger member 42 must not only be sufficient to overcome the continuing force of the trigger spring 62, but also be sufficient to overcome the force of the drink spring 70, thus allowing the seal arm 66 to compress the drink spring 70 and have the drink seal 72 be moved away from the drink apertures 18 to allow liquid to escape out of the drink aperture 18 for drinking.

When the user removes force from the drink trigger 42 (i.e., generally by removing their finger or thumb from the trigger 42), the force of the drink spring 70 will force the seal arm 66 to rotate toward the lid housing 40 and thereby have the drink seal 72 forced against the drink opening 18 to close the drink opening 18. Further, the trigger spring 62 will continue to force the trigger 42 outwardly to seal the vent seal 64 against the outside of the seal chamber 31*a* and trigger chamber 31, thereby closing the vent opening 20.

If the user desires to clean the lid assembly 14, the user can rotate the seal assembly 60 away from the lid housing 40 to provide access to the area between the drink opening 18 and the drink seal 72. To do such, in one embodiment the user rotates the locking member 96 of the seal arm locking member 68 approximately 50°. By rotating the knob 96 of the seal arm locking member 68 the locking arms 98 will simultaneous rotate and disengage from the receiving members 90 extending from the lid housing 40. When the locking arms 98 are disengaged from the receiving members 90 the entire seal assembly 60 can be rotated away from the lid housing 40 about the extensions 86 of the hinge member 56 for cleaning.

The lid assembly 14 also has a trigger locking mechanism 44 to prevent the trigger 42 from being actuated when the trigger lock mechanism 44 is in the locked position. In one embodiment the trigger lock mechanism 44 comprises a moveable vent deflector 41 with a shoulder 120 that is adapted to engage a cutout 122 in the trigger member 42 and prevent inward movement (i.e., actuation) of the trigger member 42. The vent deflector 41 can be transitioned from the unlocked position (see FIGS. 9 and 15), where the shoulder 120 of the vent deflector 41 is positioned outside of the trigger chamber 31 and thus not in contact with the trigger member 42 such that the trigger member 42 can be moved inwardly to actuate the trigger mechanism 16, to the locked position (see FIGS. 8 and 14), where the shoulder 120 of the vent deflector 41 is positioned within the trigger chamber 31 and contacting the trigger member 42 such that the trigger member 42 cannot be moved inwardly thereby preventing the trigger mechanism 16 from being actuated.

Figure 12:
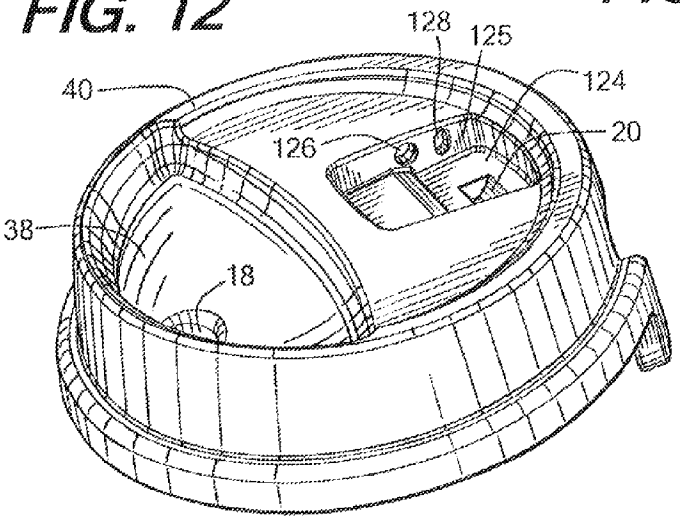
FIG. 12 is a top perspective view of one embodiment of the lid housing with the vent-trigger lock removed.
Figure 13:
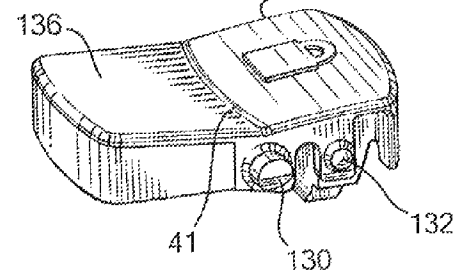
FIG. 13 is a top perspective view of one embodiment of the moveable vent-trigger lock.

Referring to FIG. 12, the lid housing 40 has a vent deflector cavity 124 for housing the vent deflector 41. The vent deflector cavity 124 has two sets of receivers in the sidewalls 125 of the vent deflector cavity 124. A first set of receivers comprises a pair of generally cylindrical openings 126, and the second set of receivers comprises a pair of slots 128. Referring to FIG. 13, the vent deflector 41 similarly has a pair of cylindrical flanges or shaft extensions 130 extending from opposing sidewalls of the vent deflector 41, and a pair of protrusions 132 similarly extending from opposing sidewalls of the vent deflector 41 distal the shaft extensions 130, although only one protrusion 132 may be required. The shaft extensions 130 reside in the cylindrical receivers 126 to allow the vent deflector 41 to pivot about the shaft extensions 130 from the locked position to the unlocked position of the trigger lock mechanism 44. Similarly, the protrusions 132 reside the in slots 128. The protrusions 132, however, operate to restrain pivoting movement of the vent deflector 41 past a certain pivot angle. Additionally, a snap fit configuration is provided at the ends of the slots 128 for maintaining the vent deflector 41 in the locked or unlocked position until moved by the user, thereby prevented unwanted movement of the vent deflector 41.

Figure 14:
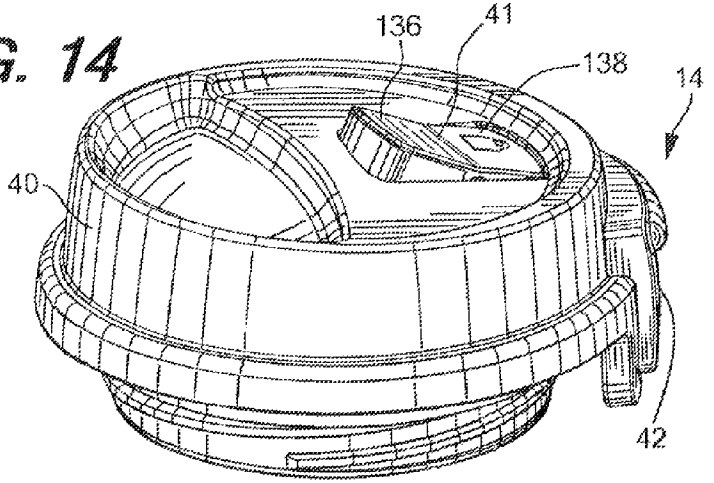
FIG. 14 is a top-side perspective view of the lid housing of FIG. 12 with the vent-trigger lock in the locked position.
Figure 15:
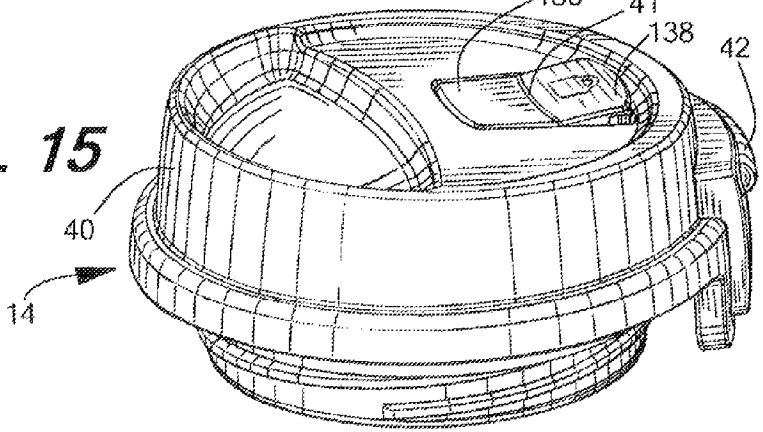
FIG. 15 is a top-side perspective view of the lid housing of FIG. 12 with the vent-trigger lock in the unlocked position.

Referring to FIGS. 8 and 14, when the front end 136 of the vent deflector 41 toward the drink aperture 18 is in the up position the rear end 138 of the vent deflector 41 is in the down position and the shoulder 120 engages the cutout 122 in the trigger member 42 to prevent inward movement (i.e., actuation) of the trigger member 42. The front end 136 of the vent deflector 41 may have a visual indicator, such as a red color or words, such as "LOCKED", that appears when the trigger lock mechanism 44 is in the locked position to indicate to the user that the trigger mechanism 16 is locked and cannot be actuated. To allow for actuation, the user presses down on the front end 136 of the vent deflector 41, thereby pivoting the front end 136 downward and the rear end 138 of the vent deflector 41 upward as shown in FIGS. 15 and 9. In this position, the shoulder 120 disengages from the cutout 122 in the trigger member 42 and allows the trigger member 42 to move inwardly when a force is applied by the user to the trigger member 42. In one embodiment the top surface 134 of the vent deflector 41 has a somewhat concave shape. To return the trigger lock mechanism 44 to the locked orientation, after the trigger 42 is positioned in its unactuated location, the user depresses the rear portion 138 of the vent deflector 41 to place the shoulder 120 of the vent deflector 41 to once again engage the cutout 122 and prevent actuation of the trigger mechanism 16.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lid assembly for a beverage container, comprising:

a lid housing;

a seal assembly pivotally connected to the lid housing while movable between a first or operable position, wherein a seal arm of the seal assembly operably engages a drink opening to open and close the drink opening in the first position, and a second or cleaning position, wherein the seal assembly is rotated away from a drink surface of the lid housing and wherein the drink opening is open for cleaning the lid assembly; and, a trigger assembly connected to the lid housing, the trigger assembly operable to be pushed radially inwardly in a direction transverse to a longitudinal axis of the beverage container, wherein the trigger assembly is capable of engaging the seal assembly when the seal assembly is in the operable position, and wherein the seal assembly cannot be engaged by the trigger assembly when the seal assembly is in the cleaning position.

2. The lid assembly of claim 1, further comprising a lock connected to the lid housing, the lock preventing engagement of the seal assembly by the trigger assembly when the seal assembly is in the operable position.

3. The lid assembly of claim 1, wherein the seal assembly can rotate approximately 90° to translate from the operable position to the cleaning position.

4. The lid assembly of claim 1, further comprising a locking member to lock the seal assembly in the operable position when the locking member is in a locked state, the locking member being transitionable to an unlocked state to allow the seal assembly to translate to the cleaning position.

5. The lid assembly of claim 1, the seal assembly further comprising a hinge member and a drink seal extending from the seal arm, wherein the hinge member is pivotally connected to the lid housing, and wherein the seal arm is pivotally attached to the hinge member.

6. The lid assembly of claim 5, further comprising a locking member connected to the seal assembly, the locking member being movable from a first position where the seal assembly is locked in the operable position, and a second position where the seal assembly is released from the locked position and can be rotated away from the lid housing to the cleaning position.

7. A lid assembly for a beverage container, comprising:

a lid housing;

a seal assembly connected to the lid housing and movable between a first or operable position, wherein a seal arm of the seal assembly assists to open and close the drink opening in the first position, and a second or cleaning position, wherein the seal assembly is positioned away from a drink surface of the lid housing and wherein a drink opening is open for cleaning the lid assembly, the seal assembly being connected to the lid housing in the first position and the second position; and, a trigger assembly connected to the lid housing, the trigger assembly operable to be pushed radially inwardly in a direction transverse to a longitudinal axis of the beverage container, and wherein the trigger assembly is capable of engaging the seal assembly when the seal assembly is in the operable position.

8. The lid assembly of claim 7, further comprising a lock connected to the lid housing, the lock preventing engagement of the seal assembly by the trigger assembly when the seal assembly is in the operable position.

9. The lid assembly of claim 7, further comprising a locking member connected to the seal assembly, the locking member being movable from a first position where the seal assembly is locked in the operable position, and a second position where the seal assembly is released from the locked position and can be positioned in the cleaning position.

10. A lid assembly for a beverage container, comprising:

a lid having a drink opening;

a seal assembly connected to the lid while movable between a first or operable position and a second or cleaning position, wherein a seal arm of the seal assembly operates to assist in opening and closing the drink opening in the first position, wherein the seal arm is positioned away from the drink opening and unable to assist in closing the drink opening in the second position for cleaning the lid assembly, the seal arm being connected to the lid in the first position and the second position; and, a trigger operable to be pushed radially inwardly to operate the seal assembly when the seal assembly is in the first position.

11. The lid assembly of claim 10, wherein the trigger is capable of engaging the seal assembly when the seal assembly is in the operable position, and wherein the seal assembly cannot be engaged by the trigger when the seal assembly is in the cleaning position.

12. The lid assembly of claim 10, wherein the trigger is separate from the sealing assembly.

13. The lid assembly of claim 10, further comprising a lock connected to the lid housing, the lock preventing engagement of the seal assembly by the trigger in a first position.

14. The lid assembly of claim 12, wherein the lock contains a visual indicator to indicate that the lock is in a locked position.

15. The lid assembly of claim 12, wherein the lock is pivotally connected to the lid housing.

16. The lid assembly of claim 12, wherein the lock extends from a top of the lid housing.

17. The lid assembly of claim 13, wherein the lock is movable from the first position, wherein the lock engages the trigger and prevents the trigger from engaging the seal assembly, to a second position, wherein the lock does not engage the trigger and the trigger is free to engage the seal assembly.

* * * * *